US010152939B2

(12) United States Patent
Liu

(10) Patent No.: US 10,152,939 B2
(45) Date of Patent: Dec. 11, 2018

(54) GATE DRIVING CIRCUIT, METHOD FOR DRIVING THE SAME, AND DISPLAY DEVICE

(71) Applicants: BOE TECHNOLOGY GROUP CO., LTD., Beijing (CN); HEFEI BOE OPTOELECTRONICS TECHNOLOGY CO., LTD., Anhui (CN)

(72) Inventor: Rongcheng Liu, Beijing (CN)

(73) Assignees: BOE TECHNOLOGY GROUP CO., LTD., Beijing (CN); HEFEI BOE OPTOELECTRONICS TECHNOLOGY CO., LTD., Anhui (CN)

( * ) Notice: Subject to any disclaimer, the term of this patent is extended or adjusted under 35 U.S.C. 154(b) by 269 days.

(21) Appl. No.: 14/408,637

(22) PCT Filed: Jul. 3, 2014

(86) PCT No.: PCT/CN2014/081554
§ 371 (c)(1),
(2) Date: Dec. 17, 2014

(87) PCT Pub. No.: WO2015/090040
PCT Pub. Date: Jun. 25, 2015

(65) Prior Publication Data

US 2016/0260404 A1 Sep. 8, 2016

(30) Foreign Application Priority Data

Dec. 18, 2013 (CN) ..... 2013 1 0699061

(51) Int. Cl.
*G09G 3/36* (2006.01)

(52) U.S. Cl.
CPC ..... *G09G 3/3677* (2013.01); *G09G 3/3674* (2013.01); *G09G 2300/08* (2013.01);
(Continued)

(58) Field of Classification Search
CPC ..... H01L 27/1225; H01L 29/7869; G02F 1/1368; G09G 2310/0286;
(Continued)

(56) References Cited

U.S. PATENT DOCUMENTS

2006/0007195 A1* 1/2006 Hu ..... G09G 3/3648 345/204
2008/0316159 A1 12/2008 Qi
(Continued)

FOREIGN PATENT DOCUMENTS

CN 101561597 A 10/2009
CN 101976550 A 2/2011
(Continued)

OTHER PUBLICATIONS

Office Action in Chinese Patent Application No. 201310699061.7, dated Feb. 15, 2016.
(Continued)

*Primary Examiner* — Robert Michaud
(74) *Attorney, Agent, or Firm* — Brooks Kushman P.C.

(57) ABSTRACT

A gate driving circuit according to the present disclosure may include: a plurality of gate driving units, each of which is connected to a pulse signal input end, a timing control signal input end and at least two adjacent gate scanning lines respectively, and configured to sequentially provide the at least two adjacent gate scanning lines connected thereto with a pulse signal inputted by the pulse signal input end under a control of a timing control signal inputted by the timing control signal input end. The pulse signal input end is connected to a gate driver which outputs the pulse signal
(Continued)

based on a number of gate scanning lines corresponding to each of the gate driving units.

20 Claims, 4 Drawing Sheets

(52) U.S. Cl.
CPC ..... *G09G 2310/0202* (2013.01); *G09G 2310/0267* (2013.01); *G09G 2310/0289* (2013.01); *G09G 2310/0291* (2013.01); *G09G 2310/08* (2013.01); *G09G 2330/08* (2013.01)

(58) Field of Classification Search
CPC ... G09G 2310/0267; G09G 2310/0289; G09G 3/20; G09G 3/36; G09G 2370/08; G09G 2330/06; G09G 3/3677; G09G 2300/08; G09G 2310/0202; G09G 2310/0291; G09G 2310/08; G09G 2330/08
See application file for complete search history.

(56) References Cited

U.S. PATENT DOCUMENTS

2011/0006301 A1* 1/2011 Yamazaki ..... H01L 27/1225 257/43
2012/0162282 A1* 6/2012 Pyeon ..... G09G 3/20 345/690
2014/0146260 A1* 5/2014 Lee ..... G02F 1/133345 349/43

FOREIGN PATENT DOCUMENTS

| | | | |
|---|---|---|---|
| CN | 102881248 | A | 1/2013 |
| CN | 103000121 | A | 3/2013 |
| CN | 103700354 | A | 4/2014 |
| JP | 2006184654 | A | 7/2006 |
| JP | 2010113110 | A | 5/2010 |
| KR | 1020070080142 | A | 8/2007 |

OTHER PUBLICATIONS

Yuanyi Zhou, "Asynchronous modulation," Beijing: China Machine Press, May 2013, pp. 159-160.
Kiumin Wang, Beijing: China Machine Press, Jan. 2010, pp. 81-82.
Jianyong Zhao, Beijing: National Defence Industry Press, Jan. 2012, pp. 22.
International Search Report and Written Opinion in PCT International Application No. PCT/CN2014/081554, dated Sep. 29, 2014.
Office Action in Chinese Patent Application No. 201310699061.7, dated Jun. 16, 2015.

* cited by examiner

-PRIOR ART-

GATE DRIVING CIRCUIT, METHOD FOR DRIVING THE SAME, AND DISPLAY DEVICE

CROSS-REFERENCE TO RELATED APPLICATION

This application is the U.S. national phase of PCT Application No. PCT/CN2014/081554 filed on Jul. 3, 2014, which claims priority to Chinese Patent Application No. 201310699061.7 filed on Dec. 18, 2013, the disclosures of which are incorporated in their entirety by reference herein.

TECHNICAL FIELD

The present disclosure relates to the field of display technology, in particular to a gate driving circuit, a method for driving the same, and a display device.

BACKGROUND

FIG. 1 is a schematic diagram showing a corresponding relationship between pulse signal input ends of a gate driving circuit chip (G-IC) and gate scanning lines according to the related art. As can be seen from FIG. 1, for each of the gate scanning lines Gate1, Gate2 . . . GateN−1, GateN, there is a pulse signal input end 101 corresponding thereto. A total number of the pulse signal input ends 101 is equal to a total number of gate scanning lines, that is, N.

With a resolution of a display panel being increased, the number of gate scanning lines is also being increased. Taking a high resolution (HD), dual gate designed liquid crystal display (LCD) panel as an example, the number of gate scanning lines thereof is 768×2=1536, so that two gate driving circuit chips each having 768 pulse signal input ends are required, so as to correspond to the gate scanning lines. It can be seen that when the number of gate scanning lines is increased, the number of the gate driving circuit chips is also increased, so that a cost of manufacturing the display panel is increased correspondingly.

Moreover, since a space of a fan-out area located at a junction of an array substrate and the gate driving circuit chip is relatively small, if wires arranged on the fan-out area are too close, a short circuit or open circuit or other defects may occur easily because of an existence of small particles and other unexpected factors.

SUMMARY

Technical Problems to be Solved

In view of the above, the present disclosure provides a gate driving circuit, a method for driving the same, and a display device, in order to solve the problem that the cost is high due to the need of a plurality of gate driving circuit chips and a short circuit or open circuit or other defects may occur easily in the display device of the related art.

Technical Solutions

To solve the above technical problem, the present disclosure provides a gate driving circuit, including:

a plurality of gate driving units, each of which is connected to a pulse signal input end, a timing control signal input end and at least two adjacent gate scanning lines respectively, and configured to sequentially provide the at least two adjacent gate scanning lines connected thereto with a pulse signal inputted by the pulse signal input end under a control of a timing control signal inputted by the timing control signal input end;

wherein the pulse signal input end is connected to a gate driver which outputs the pulse signal based on a number of gate scanning lines corresponding to each of the gate driving units.

Moreover, each of the gate driving units may include at least two sub-gate driving units, each of which is connected to a gate scanning line, the sub-gate driving unit including:

a switch unit, which is connected to a corresponding pulse signal input end and a corresponding gate scanning line, and configured to input the pulse signal inputted by the corresponding pulse signal input end into the gate scanning line connected thereto under the control of the timing control signal;

a reset switch unit, which is connected to the timing control signal input end and the corresponding gate scanning line, and configured to reset the pulse signal of the gate scanning line connected thereto under the control of the timing control signal.

Moreover, each of the gate driving units may be connected to two adjacent gate scanning lines; the timing control signal input end may include: a first timing control signal input end and a second timing control signal input end;

each of the gate driving units may include a first sub-gate driving unit and a second sub-gate driving unit, wherein the first sub-gate driving unit may include:

a first switch unit, an input end of which is connected to the corresponding pulse signal input end, an output end of which is connected to a first gate scanning line of the two adjacent gate scanning lines, and a control end of which is connected to the second timing control signal input end; which is configured to input the pulse signal inputted by the corresponding pulse signal input end into the first gate scanning line, under a control of a second timing control signal inputted by the second timing control signal input end;

a first reset switch unit, an input end of which is connected to the second timing control signal input end, an output end of which is connected to the first gate scanning line, and a control end of which is connected to the first timing control signal input end; which is configured to reset the pulse signal of the first gate scanning line under a control of the first timing control signal inputted by the first timing control signal input end;

the second sub-gate driving unit may include:

a second switch unit, an input end of which is connected to the corresponding pulse signal input end, an output end of which is connected to a second gate scanning line of the two adjacent gate scanning lines, and a control end of which is connected to the first timing control signal input end; which is configured to input the pulse signal inputted by the corresponding pulse signal input end into the second gate scanning line, under a control of a first timing control signal;

a second reset switch unit, an input end of which is connected to the first timing control signal input end, an output end of which is connected to the second gate scanning line, and a control end of which is connected to the second timing control signal input end; which is configured to reset the pulse signal of the second gate scanning line under a control of the second timing control signal.

Moreover, the first switch unit, the second switch unit, the first reset switch unit and the second reset switch unit may be N-type thin film transistors (TFTs).

Moreover, the gate driving circuit may further include:

a timing control signal generating circuit, which is connected to the timing control signal input end and configured to provide the first timing control signal and the second timing control signal, wherein the timing control signal generating circuit may include:

a thin film transistor T11, a gate electrode of which is connected to a first clock signal, a source electrode of which is connected to a high level signal, a drain electrode of which is connected to the second timing control signal input end;

a thin film transistor T12, a gate electrode of which is connected to the first clock signal, a source electrode of which is connected to a low level signal, a drain electrode of which is connected to the second timing control signal input end;

a thin film transistor T13, a gate electrode of which is connected to a first clock signal, a source electrode of which is connected to the high level signal, a drain electrode of which is connected to the first timing control signal input end;

a thin film transistor T14, a gate electrode of which is connected to the first clock signal, a source electrode of which is connected to the low level signal, a drain electrode of which is connected to the first timing control signal input end;

wherein the thin film transistor T11 and the thin film transistor T14 may be N-type thin film transistors, the thin film transistor T12 and the thin film transistor T13 may be P-type thin film transistors.

Moreover, the gate driving circuit may further include:

a frequency dividing unit, which is connected to the second clock signal and configured to perform a frequency dividing process on the second clock signal, to obtain and then output the first clock signal, a frequency of which is a half of that of the second clock signal;

the gate driver may be connected to the frequency dividing unit and configured to output the pulse signal based on the first clock signal and the number of gate scanning lines corresponding to the gate driving unit.

Moreover, the present disclosure further provides a display device including the above gate driving circuit.

Moreover, the present disclosure further provides a method for driving a gate driving circuit. The gate driving circuit may include a plurality of gate driving units, each of which is connected to a pulse signal input end, a timing control signal input end and at least two adjacent gate scanning lines respectively, wherein the pulse signal input end is connected to a gate driver. The method may include steps of: providing sequentially, by each of the gate driving units, at least two adjacent gate scanning lines connected thereto with a pulse signal inputted by the pulse signal input end, under a control of a timing control signal inputted by the timing control signal input end; and outputting, by the gate driver, the pulse signal based on a number of gate scanning lines corresponding to each of the gate driving units.

Advantageous Effects

The advantageous effects of the above-described technical solutions according to the present disclosure are as follows.

The gate driving circuit includes a plurality of gate driving units, each of which is connected to a pulse signal input end and at least two adjacent gate scanning lines, so that the pulse signal input end may control at least two adjacent gate scanning lines, i.e., control at least two rows of pixel TFT arrays to be turned on or off. Therefore, it is possible to reduce the number of the pulse signal input ends at the same time of achieving a normal display of the display panel, thereby reducing the volume and the manufacture process difficulty of the gate driving circuit and reducing the number of the gate driving circuits required by the panel. Further, since the number of the pulse signal input ends is reduced, a density of wires arranged on the fan-out area located at the junction of the array substrate and the gate driving circuit may also be reduced, so that a probability of an occurrence of the short circuit or open circuit or other defects may be reduced as well.

BRIEF DESCRIPTION OF THE DRAWINGS

In order to more clearly illustrate the technical solutions according to the embodiments of the present disclosure or the related art, accompany drawings acquired to use in the description of the embodiments will be described briefly below. It is obvious that, the described drawings are merely parts of embodiments of the present disclosure, and other drawings can also be obtained according to these drawings for a person skilled in the art without creative work.

DETAILED DESCRIPTION

Figure 1:
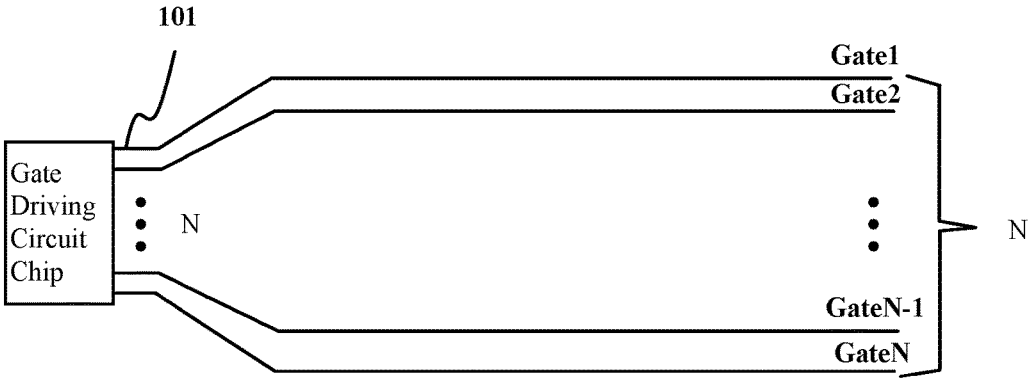
FIG. 1 is a schematic diagram showing a corresponding relationship between pulse signal input ends of a gate driving circuit chip (G-IC) and gate scanning lines according to the related art.

Specific embodiments of the present disclosure will be further described below in conjunction with the accompanying drawings and embodiments. The following embodiments are only used for illustrating the present disclosure, but are not intended to limit the scope of the disclosure.

In order to make the objects, technical solutions and advantages of the embodiments of the present disclosure more clear, the technical solutions according to the embodiments of the present disclosure will be clearly and fully described hereinafter in conjunction with the accompanying drawings in the embodiments of the present disclosure. Obviously, the described embodiments are merely parts of embodiments of the present disclosure, but not all the embodiments. Based on the embodiments in the present disclosure, all the other embodiments obtained by a person skilled in the art will fall within the protection scope of the present disclosure.

Unless otherwise defined, technical terms or scientific terms used herein shall have the general meaning which can be understood by a person skilled in the art. The terms "first", "second" or the like used in the specification and claims of the present disclosure do not denote any sequence, quantity, or importance, but rather are used to distinguish different components. Similarly, the terms "a" or "an" or the like do not mean quantitative restrictions, but rather indicate the presence of at least one. The terms "connect" or "couple" or the like are not limited to connect physically or mechanically, but may include connecting electrically either directly or indirectly. The terms "up", "down", "left", "right", etc., are merely used to indicate a relative positional relationship; when the absolute position of the described object is changed, the relative positional relationship is changed correspondingly.

In order to make the technical problems, technical solutions and advantages of the embodiments of the present disclosure more clear, description will be given below in conjunction with the accompanying drawings and specific embodiments.

In order to solve the problem that the cost is high due to the need of a plurality of gate driving circuit chips and a short circuit or open circuit or other defects may occur easily in the display device of the related art, an embodiment of the present disclosure provides a gate driving circuit, including:

a plurality of gate driving units, each of which is connected to a pulse signal input end, a timing control signal input end and at least two adjacent gate scanning lines respectively, and configured to sequentially provide the at least two adjacent gate scanning lines connected thereto with a pulse signal inputted by the pulse signal input end under a control of a timing control signal inputted by the timing control signal input end;

wherein the pulse signal input end is connected to a gate driver, each of which outputs the pulse signal based on a number of gate scanning lines corresponding to the gate driving units.

Figure 2:
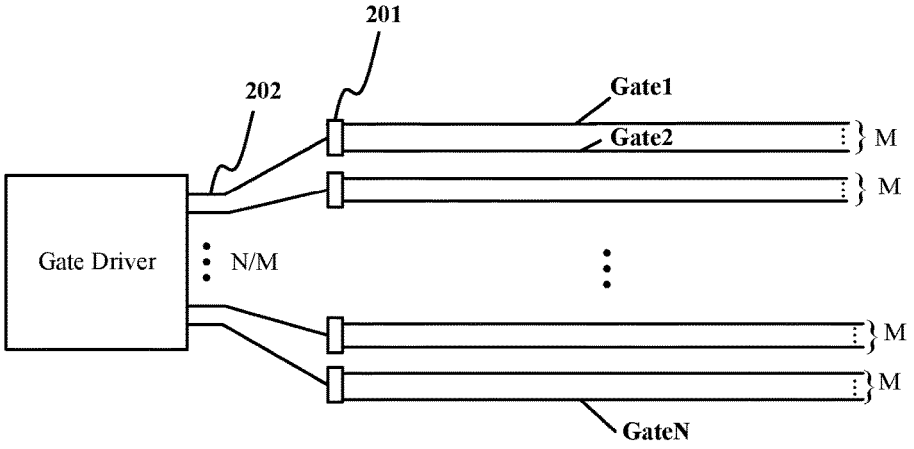
FIG. 2 is a schematic diagram showing a structure of a gate driving circuit according to an embodiment of the present disclosure.

FIG. 2 is a schematic diagram showing a structure of a gate driving circuit according to an embodiment of the present disclosure. The gate driving circuit is configured to sequentially provide the N gate scanning lines Gate1 . . . GateN with pulse signals. The gate driving circuit includes a plurality of gate driving units 201, each of which is connected to a pulse signal input end 202, a timing control signal input end (not shown) and M (which is greater than or equal to 2) adjacent gate scanning lines respectively, and configured to sequentially provide the M adjacent gate scanning lines connected thereto with a pulse signal inputted by the pulse signal input end 202 under a control of a timing control signal inputted by the timing control signal input end.

The pulse signal input end 202 is connected to a gate driver which outputs the pulse signal based on a total number (N) of gate scanning lines, Gate1 . . . GateN, corresponding to the gate driving units.

Here, N and M are both positive integers.

It can be seen from the embodiment as shown in FIG. 2 that, one pulse signal input end 202 may control M adjacent gate scanning lines, i.e., control M rows of pixel TFT arrays to be turned on or off. Therefore, it is possible to reduce the number of the pulse signal input ends 202 (reduced to N/M from N according to the related art), at the same time of achieving a normal display of the panel, thereby reducing the volume and the production process difficulty of the gate driving circuit and reducing the number of the gate driving circuits required by the panel. Further, since the number of the pulse signal input ends is reduced, a density of wires arranged on a fan-out area located at a junction of an array substrate and the gate driving circuit may also be reduced, so that a probability of an occurrence of a short circuit or open circuit or other defects may be reduced as well.

Next, a structure of the gate driving unit in the above-described embodiment will be specifically described.

In an embodiment of the present disclosure, each of the gate driving units may include at least two sub-gate driving units, each of which is connected to a gate scanning line.

The sub-gate driving unit includes:

a switch unit, which is connected to a corresponding pulse signal input end and a corresponding gate scanning line, and configured to input the pulse signal inputted by the corresponding pulse signal input end into the gate scanning line connected thereto under the control of the timing control signal;

a reset switch unit, which is connected to the timing control signal input end and the corresponding gate scanning line, and configured to reset the pulse signal of the gate scanning line connected thereto under the control of the timing control signal.

Description will be given with an example where each of the gate driving units may be connected to two adjacent gate scanning lines. In this case, the timing control signal input end may include: a first timing control signal input end and a second timing control signal input end.

Each of the gate driving units may include a first sub-gate driving unit and a second sub-gate driving unit.

The first sub-gate driving unit may include:

a first switch unit, an input end of which is connected to the corresponding pulse signal input end, an output end of which is connected to a first gate scanning line of the two adjacent gate scanning lines, and a control end of which is connected to the second timing control signal input end; which is configured to input the pulse signal inputted by the corresponding pulse signal input end into the first gate scanning line, under a control of a second timing control signal inputted by the second timing control signal input end;

a first reset switch unit, an input end of which is connected to the second timing control signal input end, an output end of which is connected to the first gate scanning line, and a control end of which is connected to the first timing control signal input end; which is configured to reset the pulse signal of the first gate scanning line under a control of the first timing control signal inputted by the first timing control signal input end.

The second sub-gate driving unit may include:

a second switch unit, an input end of which is connected to the corresponding pulse signal input end, an output end of which is connected to a second gate scanning line of the two adjacent gate scanning lines, and a control end of which is connected to the first timing control signal input end; which is configured to input the pulse signal inputted by the corresponding pulse signal input end into the second gate scanning line, under a control of a first timing control signal;

a second reset switch unit, an input end of which is connected to the first timing control signal input end, an output end of which is connected to the second gate scanning line, and a control end of which is connected to the second timing control signal input end; which is configured to reset the pulse signal of the second gate scanning line under a control of the second timing control signal.

Figure 3:
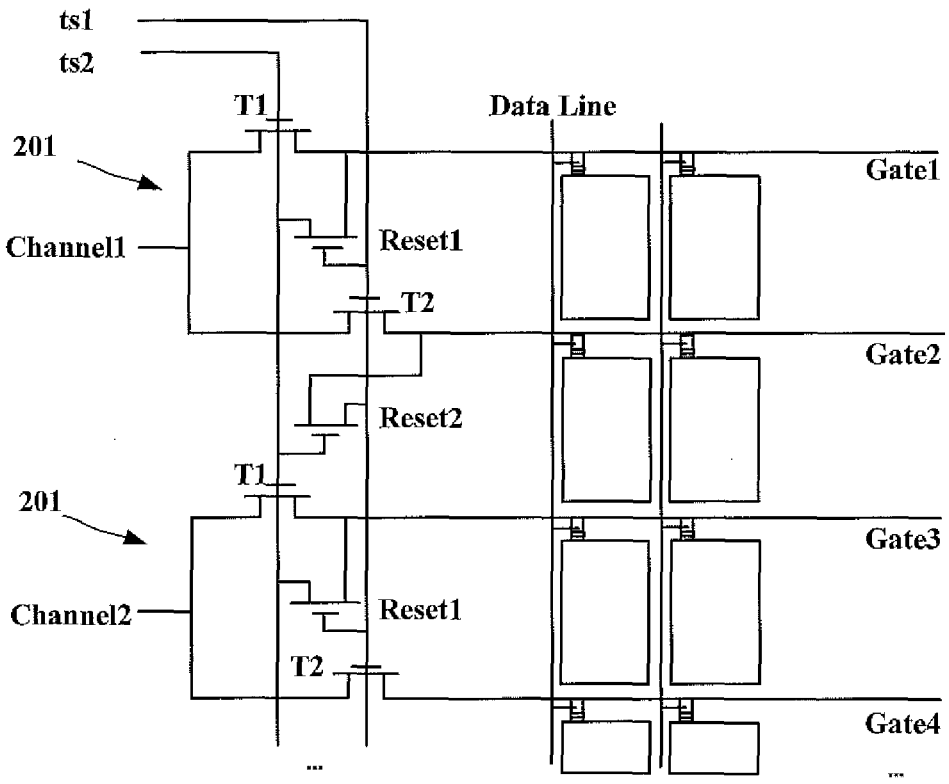
FIG. 3 is another schematic diagram showing a structure of a gate driving circuit according to an embodiment of the present disclosure.

FIG. 3 is another schematic diagram showing a structure of a gate driving circuit according to an embodiment of the present disclosure. In the embodiment of the present disclosure, one pulse signal input end of the gate driving circuit can control two gate scanning lines.

The gate driving circuit includes: a plurality of gate driving units 201, each of which is connected to a pulse signal (channel1, channel2 . . . ) input end, a first timing control signal (ts1) input end, a second timing control signal (ts2) input end and two adjacent gate scanning lines (Gates), respectively; and configured to sequentially provide the two adjacent gate scanning lines connected thereto with a pulse signal inputted by the pulse signal input end under a control of a timing control signal inputted by the timing control signal input end.

Each of the gate driving units includes a first sub-gate driving unit and a second sub-gate driving unit.

The first sub-gate driving unit includes:

a first switch unit T1, an input end of which is connected to the corresponding pulse signal input end, an output end of which is connected to a first gate scanning line of the two adjacent gate scanning lines, and a control end of which is connected to the second timing control signal input end; which is configured to input the pulse signal inputted by the corresponding pulse signal input end into the first gate scanning line, under a control of a second timing control signal inputted by the second timing control signal input end;

a first reset switch unit Reset1, an input end of which is connected to the second timing control signal input end, an output end of which is connected to the first gate scanning line, and a control end of which is connected to the first timing control signal input end; which is configured to reset the pulse signal of the first gate scanning line under a control of the first timing control signal inputted by the first timing control signal input end.

The second sub-gate driving unit includes:

a second switch unit T2, an input end of which is connected to the corresponding pulse signal input end, an output end of which is connected to a second gate scanning line of the two adjacent gate scanning lines, and a control end of which is connected to the first timing control signal input end; which is configured to input the pulse signal inputted by the corresponding pulse signal input end into the second gate scanning line, under a control of a first timing control signal;

a second reset switch unit Reset2, an input end of which is connected to the first timing control signal input end, an output end of which is connected to the second gate scanning line, and a control end of which is connected to the second timing control signal input end; which is configured to reset the pulse signal of the second gate scanning line under a control of the second timing control signal.

Description will be given with an example where the first switch unit, the second switch unit, the first reset switch unit and the second reset switch unit are all N-type thin film transistors (TFTs).

It can be seen from the embodiment as shown in FIG. 3 that, one pulse signal input end may control two (2) adjacent gate scanning lines, i.e., control two rows of pixel TFT arrays to be turned on or off. Therefore, it is possible to reduce the number of the pulse signal input ends (reduced to N/2 from N according to the related art), at the same time of achieving a normal display of the panel, thereby reducing the volume and the production process difficulty of the gate driving circuit and reducing the number of the gate driving circuits required by the panel. Further, since the number of the pulse signal input ends is reduced, a density of wires arranged on a fan-out area located at a junction of an array substrate and the gate driving circuit may also be reduced, so that a probability of an occurrence of a short circuit or open circuit or other defect may be reduced as well.

In order to provide timing control signals, the gate driving circuit according to an embodiment of the present disclosure may also include:

a timing control signal generating circuit, which is connected to the timing control signal input end and configured to provide the first timing control signal and the second timing control signal.

Figure 4:
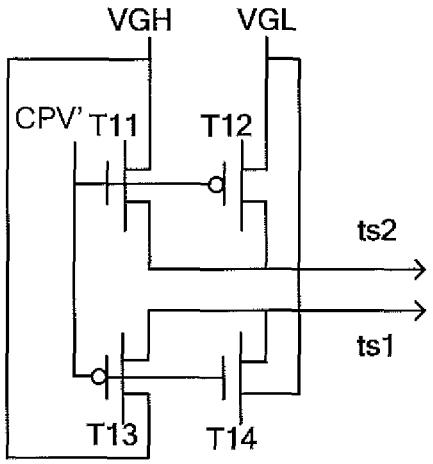
FIG. 4 is a schematic diagram showing a structure of a timing control signal generating circuit according to an embodiment of the present disclosure.

FIG. 4 is a schematic diagram showing a structure of a timing control signal generating circuit according to an embodiment of the present disclosure. The timing control signal generating circuit may include:

a thin film transistor T11, a gate electrode of which is connected to a first clock signal CPV', a source electrode of which is connected to a high level signal VGH, a drain electrode of which is connected to the second timing control signal (ts2) input end;

a thin film transistor T12, a gate electrode of which is connected to the first clock signal CPV', a source electrode of which is connected to a low level signal VGL, a drain electrode of which is connected to the second timing control signal (ts2) input end;

a thin film transistor T13, a gate electrode of which is connected to a first clock signal CPV', a source electrode of which is connected to the high level signal VGH, a drain electrode of which is connected to the first timing control signal (ts1) input end;

a thin film transistor T14, a gate electrode of which is connected to the first clock signal CPV', a source electrode of which is connected to the low level signal VGL, a drain electrode of which is connected to the first timing control signal (ts1) input end.

The thin film transistor T11 and the thin film transistor T14 are N-type thin film transistors, the thin film transistor T12 and the thin film transistor T13 are P-type thin film transistors.

It is obvious that the timing control signal generating circuit can also have other structures, which will not be described here.

Figure 5:
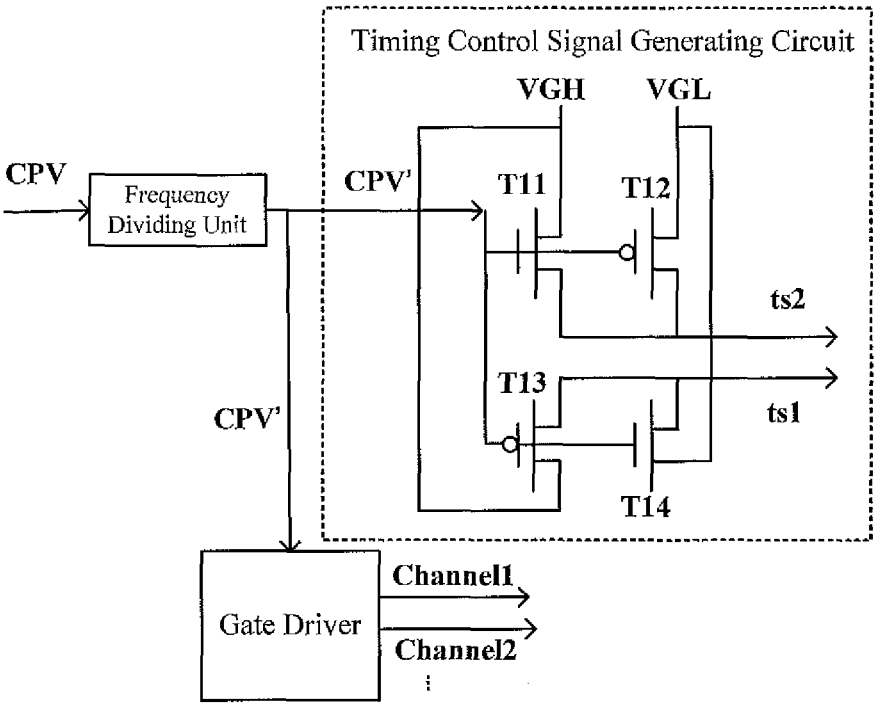
FIG. 5 is yet another schematic diagram showing a structure of a gate driving circuit according to an embodiment of the present disclosure.

Referring to FIG. 5, in order to provide the pulse signal, the gate driving circuit according to an embodiment of the present disclosure may further include:

a frequency dividing unit, connected to the second clock signal CPV and configured to perform a frequency dividing process on the second clock signal CPV, to obtain and then output the first clock signal CPV'. A frequency of the first clock signal CPV' is a half of that of the second clock signal CPV.

Further, the gate driver is connected to the frequency dividing unit and configured to output the pulse signal based on the first clock signal CPV' and the number of gate scanning lines corresponding to the gate driving unit.

Based on the above frequency dividing unit, the clock signal CPV' of the embodiment of the present disclosure can be obtained by using an existing clock signal CPV for driving gate scanning lines, thereby there is no need to change the Printed Circuit Board+Assembly (PCBA) which provides gate electrode scanning clock signals, so as to reduce the modification difficulty.

Figure 6:
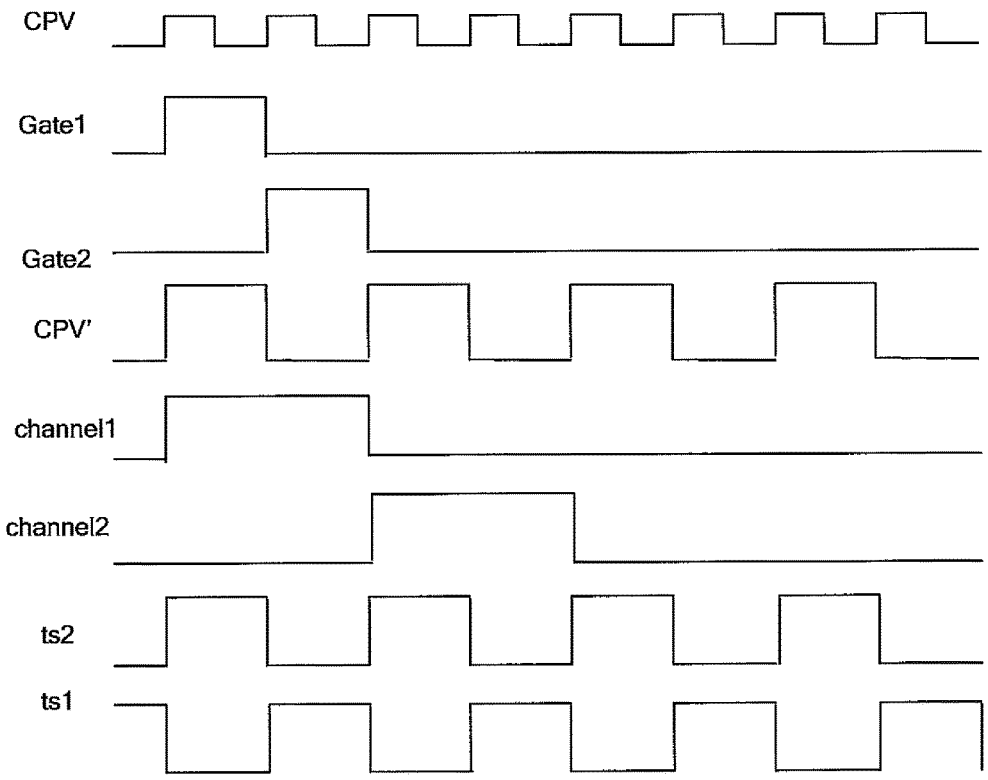
FIG. 6 is a schematic diagram showing a timing relationship among respective signals according to an embodiment of the present disclosure.

FIG. 6 is a schematic diagram showing a timing relationship among respective signals according to an embodiment of the present disclosure.

The present disclosure further provides a display device including the above gate driving circuit.

The present disclosure further provides a method for driving a gate driving circuit. The gate driving circuit may include a plurality of gate driving units, each of which is connected to a pulse signal input end, a timing control signal input end and at least two adjacent gate scanning lines respectively, wherein the pulse signal input end is connected to a gate driver. The method may include steps of:

providing sequentially, by each of the gate driving units, at least two adjacent gate scanning lines connected thereto with a pulse signal inputted by the pulse signal input end, under a control of a timing control signal inputted by the timing control signal input end; and outputting, by the gate driver, the pulse signal based on a number of gate scanning lines corresponding to each of the gate driving units.

The above is only preferred embodiments of the present disclosure, it should be noted that several improvements and modifications may be made for a person skilled in the art without departing from the principle of the present disclosure, and also should be considered to fall within the protection scope of the present disclosure.

What is claimed is:

1. A gate driving circuit, comprising:

a gate driver configured to provide corresponding pulse signals to N gate scanning lines respectively via N/M gate driving units;

the N/M gate driving units, each of which is at its input end connected to a timing control signal input end and the gate driver via a pulse signal input end, and each of which is at its output end connected to M adjacent gate scanning lines, and configured to sequentially provide the M adjacent gate scanning lines connected thereto with a pulse signal inputted by the pulse signal input end under a control of a timing control signal inputted by the timing control signal input end, where both N and M are positive integers and N is an integral multiple of M;

wherein the gate driver outputs the pulse signal based on a total number M of gate scanning lines corresponding to each of the gate driving units; and wherein a fanout region between the gate driver and the N/M gate driving units only includes N/M gate connection lines, whereas a display region between the N/M gate driving units and elements to be driven includes N gate scanning lines.

2. The gate driving circuit according to claim 1, wherein each of the gate driving units comprises at least two sub-gate driving units, each of which is connected to a gate scanning line, wherein each of the at least two sub-gate driving units comprises:

a switch unit, which is connected to a corresponding pulse signal input end and a corresponding gate scanning line, and configured to input the pulse signal inputted by the corresponding pulse signal input end into the gate scanning line connected thereto under the control of the timing control signal.

3. The gate driving circuit according to claim 2, wherein each of the at least two sub-gate driving units further comprises:

a reset switch unit, which is connected to the timing control signal input end and the corresponding gate scanning line, and which is configured to reset the pulse signal of the gate scanning line connected thereto under the control of the timing control signal.

4. The gate driving circuit according to claim 1, wherein each of the at least two sub-gate driving units is connected to two adjacent gate scanning lines; wherein the timing control signal input end comprises: a first timing control signal input end and a second timing control signal input end;

wherein each of the at least two sub-gate driving units comprises a first sub-gate driving unit and a second sub-gate driving unit.

5. The gate driving circuit according to claim 2, wherein each of the at least two sub-gate driving units is connected to two adjacent gate scanning lines; wherein the timing control signal input end comprises: a first timing control signal input end and a second timing control signal input end;

wherein each of the at least two sub-gate driving units comprises a first sub-gate driving unit and a second sub-gate driving unit.

6. The gate driving circuit according to claim 3, wherein each of the gate driving units is connected to two adjacent gate scanning lines; wherein the timing control signal input end comprises: a first timing control signal input end and a second timing control signal input end;

wherein each of the gate driving units comprises a first sub-gate driving unit and a second sub-gate driving unit.

7. The gate driving circuit according to claim 4, wherein the first sub-gate driving unit comprises:

a first switch unit, an input end of which is connected to the corresponding pulse signal input end, an output end of which is connected to a first gate scanning line of the two adjacent gate scanning lines, and a control end of which is connected to the second timing control signal input end; which is configured to input the pulse signal inputted by the corresponding pulse signal input end into the first gate scanning line, under the control of a second timing control signal inputted by the second timing control signal input end.

8. The gate driving circuit according to claim 7, wherein the first sub-gate driving unit further comprises:

a first reset switch unit, an input end of which is connected to the second timing control signal input end, an output end of which is connected to the first gate scanning line, and a control end of which is connected to the first timing control signal input end; which is configured to reset the pulse signal of the first gate scanning line under the control of the first timing control signal inputted by the first timing control signal input end.

9. The gate driving circuit according to claim 4, wherein the second sub-gate driving unit comprises:

a second switch unit, an input end of which is connected to the corresponding pulse signal input end, an output end of which is connected to a second gate scanning line of the two adjacent gate scanning lines, and a control end of which is connected to the first timing control signal input end; which is configured to input the pulse signal inputted by the corresponding pulse signal input end into the second gate scanning line, under the control of a first timing control signal.

10. The gate driving circuit according to claim 9, wherein the second sub-gate driving unit further comprises:

a second reset switch unit, an input end of which is connected to the first timing control signal input end, an output end of which is connected to the second gate scanning line, and a control end of which is connected to the second timing control signal input end; which is configured to reset the pulse signal of the second gate scanning line under the control of a second timing control signal.

11. The gate driving circuit according to claim 8, wherein the first switch unit and the first reset switch unit are formed by both N-type thin film transistors (TFTs).

12. The gate driving circuit according to claim 7, further comprising:

a timing control signal generating circuit, which is connected to the timing control signal input end, and which is configured to provide the first timing control signal and the second timing control signal.

13. The gate driving circuit according to claim 12, wherein the timing control signal generating circuit comprises:

a first thin film transistor, a gate electrode of which is connected to a first clock signal, a source electrode of which is connected to a high level signal, a drain electrode of which is connected to the second timing control signal input end;

a second thin film transistor, a gate electrode of which is connected to the first clock signal, a source electrode of which is connected to a low level signal, a drain electrode of which is connected to the second timing control signal input end;

a third thin film transistor, a gate electrode of which is connected to a first clock signal, a source electrode of which is connected to the high level signal, a drain electrode of which is connected to the first timing control signal input end;

a fourth thin film transistor, a gate electrode of which is connected to the first clock signal, a source electrode of which is connected to the low level signal, a drain electrode of which is connected to the first timing control signal input end.

14. The gate driving circuit according to claim 13, wherein the first thin film transistor and the fourth thin film transistor are N-type thin film transistors.

15. The gate driving circuit according to claim 13, wherein the second thin film transistor and the third thin film transistor are P-type thin film transistors.

16. The gate driving circuit according to claim 13, further comprising:

a frequency dividing unit, which is inputted with the second clock signal and configured to perform a frequency dividing process on the second clock signal, to obtain and then output the first clock signal, a frequency of which is a half of that of the second clock signal.

17. The gate driving circuit according to claim 16, wherein the gate driver is connected to the frequency dividing unit and is configured to output the pulse signal based on the first clock signal and the number of gate scanning lines corresponding to the gate driving unit.

18. A display device, comprising a gate driving circuit which comprises:

a gate driver configured to provide corresponding pulse signals to N gate scanning lines respectively via N/M gate driving units;

the N/M gate driving units, each of which is at its input end connected to a timing control signal input end and the gate driver via a pulse signal input end, and each of which is at its output end connected to M adjacent gate scanning lines, and configured to sequentially provide the M adjacent gate scanning lines connected thereto with a pulse signal inputted by the pulse signal input end under a control of a timing control signal inputted by the timing control signal input end, where both N and M are positive integers and N is an integral multiple of M;

wherein the gate driver outputs the pulse signal based on a total number M of gate scanning lines corresponding to each of the gate driving units; and wherein a fanout region between the gate driver and the N/M gate driving units only includes N/M gate connection lines, whereas a display region between the N/M gate driving units and elements to be driven includes N gate scanning lines.

19. A method for driving a gate driving circuit, the gate driving circuit comprising:

a gate driver configured to provide corresponding pulse signals to N gate scanning lines respectively via N/M gate driving units;

the N/M gate driving units, each of which is at its input end connected to a timing control signal input end and the gate driver via a pulse signal input end, and each of which is at its output end connected to M adjacent gate scanning lines where both N and M are positive integers and N is an integral multiple of M, wherein a fanout region between the gate driver and the N/M gate driving units only includes N/M gate connection lines, whereas a display region between the N/M gate driving units and elements to be driven includes N gate scanning lines, the method comprising:

providing sequentially, by each of the gate driving units, M adjacent gate scanning lines connected thereto with a pulse signal inputted by the pulse signal input end, under a control of a timing control signal inputted by the timing control signal input end; and outputting, by the gate driver, the pulse signal based on a total number M of gate scanning lines corresponding to each of the gate driving units.

20. The gate driving circuit according to claim 1, wherein each connection line among the N/M gate connection lines is connected with one corresponding gate driving unit among the N/M gate driving units; and each gate driving unit among the N/M gate driving units is connected with M corresponding gate scanning lines within a same display region.

* * * * *